US010472907B2

(12) United States Patent
Johnson

(10) Patent No.: US 10,472,907 B2
(45) Date of Patent: Nov. 12, 2019

(54) DRILL BASKET

(71) Applicant: Meadow Power & Equipment Ltd., Meadow Lake (CA)

(72) Inventor: Troy Dean Johnson, Meadow Lake (CA)

(73) Assignee: Saskatoon Material Handling Ltd., Saskatoon (CA)

( * ) Notice: Subject to any disclaimer, the term of this patent is extended or adjusted under 35 U.S.C. 154(b) by 433 days.

(21) Appl. No.: 14/951,082

(22) Filed: Nov. 24, 2015

(65) Prior Publication Data

US 2017/0145754 A1 May 25, 2017

(51) Int. Cl.

| | |
|---|---|
| ***E21B 15/00*** | (2006.01) |
| ***E21B 19/24*** | (2006.01) |
| ***E21B 7/02*** | (2006.01) |

(52) U.S. Cl.

CPC ..... *E21B 19/24* (2013.01); *E21B 7/026* (2013.01)

(58) Field of Classification Search

CPC ..... E21B 15/00; E21B 19/24
USPC ..... 182/113, 21
See application file for complete search history.

(56) References Cited

U.S. PATENT DOCUMENTS

| | | | | |
|---|---|---|---|---|
| 1,636,886 | A * | 7/1927 | Wertzberger | E21B 15/00 52/223.4 |
| 3,917,005 | A | 11/1975 | Cannon et al. | |
| 4,253,547 | A | 3/1981 | Skaalen et al. | |
| 4,915,549 | A | 4/1990 | Riddell | |
| 5,582,467 | A | 12/1996 | Drolet et al. | |
| 6,022,068 | A * | 2/2000 | D'Amico | B60P 1/286 296/183.2 |
| 8,342,267 | B1 | 1/2013 | Hinshaw et al. | |
| 8,651,236 | B2 * | 2/2014 | Bowden | B66F 11/04 182/113 |
| 2012/0241255 | A1 | 9/2012 | Gomez Santamaria et al. | |
| 2015/0144426 | A1 * | 5/2015 | Hao | B66F 17/006 182/113 |

FOREIGN PATENT DOCUMENTS

| | | |
|---|---|---|
| GB | 2 280 468 A | 2/1995 |
| JP | 3806731 B2 | 8/2006 |
| WO | WO 2011/106830 A1 | 9/2011 |

* cited by examiner

*Primary Examiner* — David J Bagnell
*Assistant Examiner* — Yanick A Akaragwe
(74) *Attorney, Agent, or Firm* — Patterson Thuente Pedersen, P.A.

(57) ABSTRACT

A walled work platform or man basket configured for positioning near a surface to be drilled, the platform comprising at least one drill assembly mounting point on a leading edge of the platform wall and a tension member connected to the platform wall adjacent the drill assembly mounting point and extending rearwardly for connection at a rear portion of the platform wall.

26 Claims, 8 Drawing Sheets

DRILL BASKET

FIELD OF THE INVENTION

The present invention relates to drill equipment, and specifically to support structures for enabling drilling of target surfaces.

BACKGROUND OF THE INVENTION

It is known in the art of subsurface resource recovery to employ drills of varying sizes and capacities to loosen and extract the target resource. For example, subsurface potash seams may be recovered be sinking shafts to the layer of interest and employing drilling or rubblizing equipment to break down the target layer to enable extraction to surface. Drilling equipment can be and is used to both form the mining shafts and to remove the target resource.

Drills are commonly mounted on mobile equipment that can be used to position the drill adjacent the surface to be drilled or bored. For example, U.S. Pat. No. 4,915,549 to Riddell discloses a mobile drilling apparatus comprising a work platform that can be selectively raised and lowered along with a series of vertically-spaced drills. In a further example, U.S. Pat. No. 8,342,267 to Hinshaw et al. discloses a mining apparatus where both a work platform and a drill are supported on a vehicle-mounted boom.

It is known to use equipment such as a telehandler to elevate and position a walled work platform or man basket in a desired raised location to enable work, including in subsurface environments. However, it is the common view that mounting a drill assembly on such a man basket would require a very heavy basket design for stability purposes, given the significant twisting and pushing forces exerted on the drill assembly base during drill operation, and the telehandler models conventionally employed would require a lighter basket design for reasons of safety within the designed load chart.

What is needed, therefore, is a drill basket capable of mounting on a telehandler while addressing the need for stability during drill use.

SUMMARY OF THE INVENTION

The present invention therefore seeks to provide a drill basket having one or more drill mounting locations at a leading edge of the basket, with a tension member connecting the mounting location to a rear portion of the basket.

According to a first broad aspect of the present invention, there is provided a work platform comprising:

a base;

a peripheral wall connected to the base;

at least one drill assembly mounting member on a leading edge of the peripheral wall, the drill assembly mounting member configured to receive a drill assembly; and a tension member connected to the peripheral wall adjacent the drill assembly mounting member and extending rearwardly to connect to a rear portion of the peripheral wall.

In exemplary embodiments of the first aspect, the base is configured to support at least one person. The base and the peripheral wall are preferably composed at least partly of high tensile steel, and most preferably Hardox™ 700.

The peripheral wall preferably comprises a forward wall, a rearward wall, and two side walls, in which case the at least one drill assembly mounting member is preferably located adjacent at least one end of the forward wall.

In some embodiments, the tension member comprises a tension rod and turnbuckle. The tension member is preferably connected at a forward end to an upper front corner of the peripheral wall, and at a rearward end to a lower middle portion of the rear portion of the peripheral wall. In some embodiments, the at least one drill assembly mounting member comprises two drill assembly mounting members, one at each end of the forward wall, a forward end of the tension member selectively connectable to the peripheral wall adjacent either of the drill assembly mounting members.

According to a second broad aspect of the present invention, there is provided a drill basket for use with positioning equipment, the drill basket comprising:

a walled work platform comprising a leading side and a trailing side;

mounting means on the trailing side for mounting the drill basket on the positioning equipment;

at least one drill attachment point on the leading side for receiving a drill; and a tension member connecting the leading side adjacent the drill attachment point to the trailing side.

In exemplary embodiments of the second aspect, the positioning equipment is a telehandler. The telehandler is preferably provided with hydraulic power means, such that the drill can be powered using the hydraulic power means.

The leading side preferably comprises first and second ends. The at least one drill attachment point may be located at either the first end or the second end. Alternatively, the at least one drill attachment point may comprise two drill attachment points, one at each of the first end and the second end, a forward end of the tension member selectively connectable to the leading side adjacent either of the drill attachment points. The tension member preferably comprises a tension rod and turnbuckle.

The walled work platform is preferably configured to support at least one person, and is preferably composed at least partly of high tensile steel, and most preferably Hardox™ 700.

According to a third broad aspect of the present invention, there is provided a drilling system comprising:

positioning equipment;

a drill basket supported by the positioning equipment for positioning the drill basket adjacent a surface to be drilled, the drill basket comprising:

- a walled work platform comprising a leading side and a trailing side;
- mounting means on the trailing side for mounting the drill basket on the positioning equipment;
- at least one drill attachment point on the leading side; and
- a tension member connecting the leading side adjacent the drill attachment point to the trailing side; and a drill assembly mounted on the drill attachment point, the drill assembly comprising a drill configured for drilling into the surface.

In exemplary embodiments of the third aspect, the positioning equipment is a telehandler. The telehandler is preferably provided with hydraulic power means, further comprising hydraulic lines between the telehandler and the drill such that the drill can be powered using the hydraulic power means.

The leading side preferably comprises first and second ends. The at least one drill attachment point may be located at either the first end or the second end. Alternatively, the at least one drill attachment point may comprise two drill attachment points, one at each of the first end and the second end, a forward end of the tension member selectively connectable to the leading side adjacent either of the drill attachment points. The tension member preferably comprises a tension rod and turnbuckle.

The walled work platform is preferably configured to support at least one person, and is preferably composed at least partly of high tensile steel, and most preferably Hardox™ 700.

A detailed description of exemplary embodiments of the present invention is given in the following. It is to be understood, however, that the invention is not to be construed as being limited to these embodiments. The exemplary embodiments are directed to a particular application of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Figure 1:
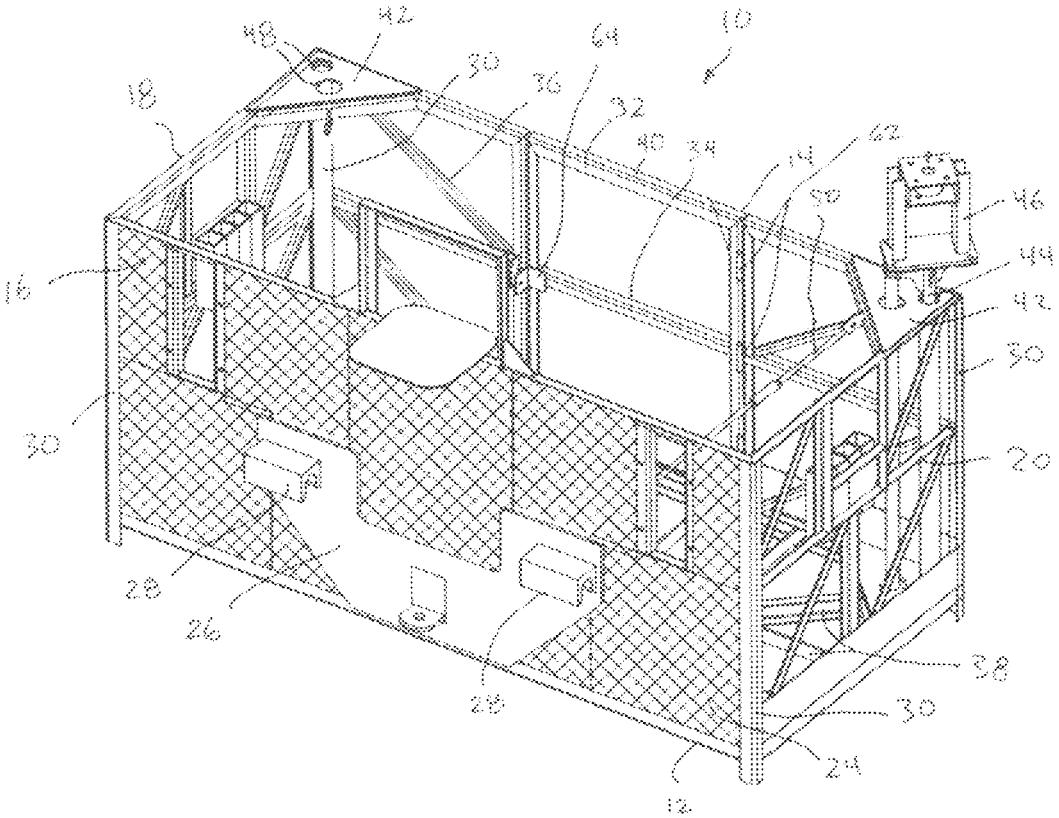
FIG. 1 is a rear perspective view of a first embodiment of the present invention, with a single drill mount assembly.

Exemplary embodiments of the present invention will now be described with reference to the accompanying drawings.

DETAILED DESCRIPTION OF THE DRAWINGS

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the invention to the precise form of the exemplary embodiment. Accordingly, the description and drawings are to be regarded in an illustrative, rather than a restrictive, sense.

The exemplary embodiments are man baskets provided with one or more drill mounting assemblies at a forward corner or corners of the man basket, with one or more tension members between the forward and rearward sides of the man basket for stability, and means for mounting the man basket on a telehandler or similar equipment to vertically and horizontally locate the man basket adjacent a target surface.

Turning to FIGS. 1 to 6, a first embodiment of a drill basket according to the present invention is illustrated. A drill basket 10 is shown, the drill basket 10 comprising a base 12 and a peripheral wall. The peripheral wall comprises a forward wall 14, a rearward wall 16, and right and left side walls 18, 20. The base 12 is composed of high tensile steel, which in the exemplary embodiment is Hardox™ 700 but other comparable materials would be known to those skilled in the art. The base 12 comprises a series of floor supports 38, which can be seen in FIGS. 1 and 2, and this structure is overlain with a conventional expanded metal floor grating (not shown) sufficient to support the weight of at least one human operator, selection of which would be within the knowledge of a person skilled in the art. Welding is preferably used to connect the various plate and structural steel, both for the base 12 and the peripheral wall.

The four walls 14, 16, 18, 20 are also composed of high tensile steel, again preferably but not necessarily Hardox™ 700. As can be seen in FIGS. 1 and 3 to 6, each of the walls 14, 16, 18, 20 comprise vertical members 30 at the ends (and at intermediate positions for the forward and rearward walls 14, 16), top horizontal members 32, median horizontal members 34, and angled wall supports 36. The support structure is preferably but not necessarily composed of bent steel sections. This structure is overlain with a steel wall mesh 24, which is shown in FIG. 1 on only the rearward wall 16.

As the drill basket 10 is intended to provide a work platform for at least one human operator, the forward wall 14 is also provided with a door 40. The door 40 is hinged in a conventional manner (see hinges 62 in FIG. 1) to allow the human operator to enter the drill basket 10 and close and secure the door 40 behind them using a conventional door latch member 64 before operation of the drill apparatus.

Figure 2:
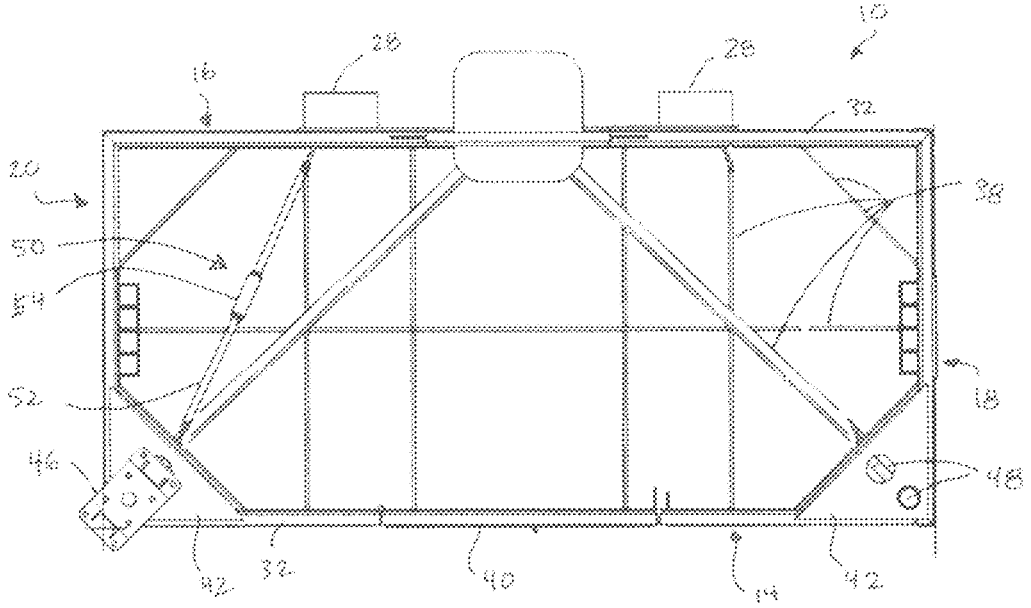
FIG. 2 is a top plan view of the first embodiment.
Figure 3:
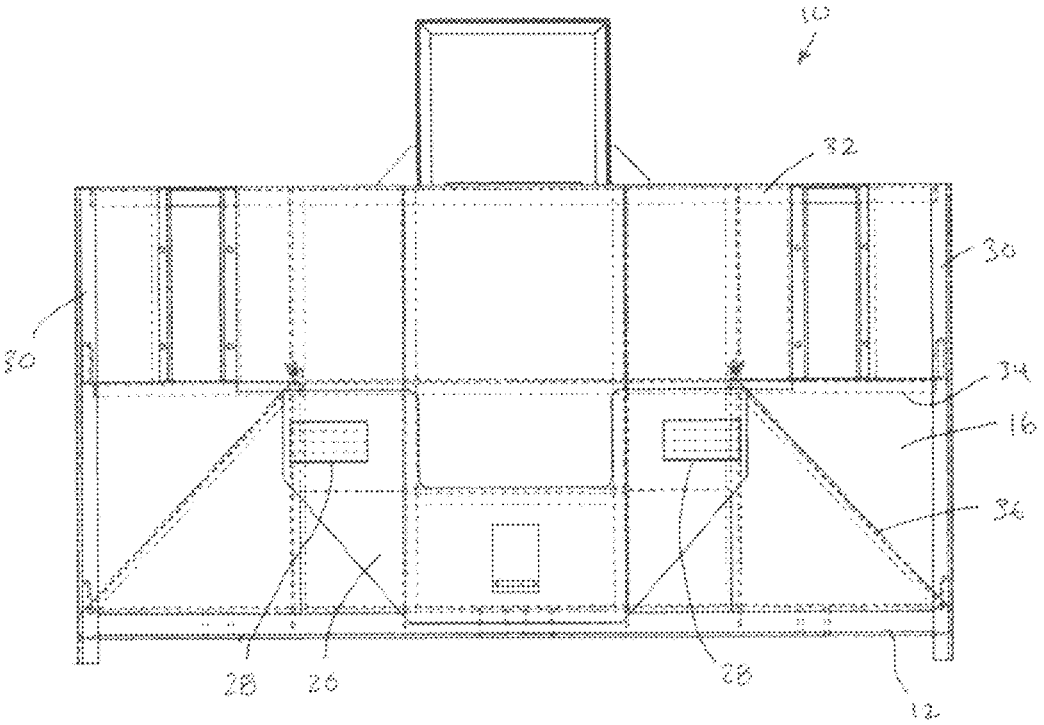
FIG. 3 is a rear elevation view of the first embodiment.

As can best be seen in FIGS. 1 to 3, the rearward wall 16 of the drill basket 10 is provided with a lifting assembly 26. The lifting assembly 26 is used to enable connection between the drill basket 10 and a piece of equipment sufficient to lift the drill basket 10 into a desired elevated position. While not shown, a telehandler is a preferred piece of equipment for this purpose, although other types of mobile equipment sufficient for this purpose would be known to those skilled in the art, such as for example an overhead travelling crane or a forklift. The lifting assembly 26 comprises connection members 28, which are lifting lugs that would be used for mounting the drill basket 10 on the boom of a telehandler. Once mounted on the telehandler boom in this way, the telehandler could be operated in a conventional manner to position the drill basket 10 vertically and horizontally in a location desirable for being adjacent to the surface the drill operator intends to work on.

The exemplary drill basket 10 is also provided with means to support a drill assembly, as drilling support is the primary function of the drill basket 10. In the exemplary embodiment of FIGS. 1 to 6, the drill basket 10 is provided with corner plates 42 above each end vertical member 30 of the forward wall 14. Each corner plate 42 is triangular in shape and is welded to the top horizontal members 32. Each corner plate 42 is provided with two apertures 48. The apertures 48 are designed to receive a post assembly 44.

The post assembly 44 comprises two posts, extending downwardly through each of the apertures 48, providing both support for the drill assembly and conduits for passage of hydraulic lines and/or cylinders. The hydraulic cylinder (not shown) would be used to provide the drill assembly with vertical movement to pre-form the drilling function. As the drill rotates the appropriate bit to core a hole, the hydraulic cylinder provides vertical movement to the drill bit to achieve a deeper hole in the desired overhead surface. While not shown, hydraulic lines can be run from the telehandler or similar equipment to power the drill assembly, thus eliminating the need for an auxiliary power pack or air system.

Figure 4:
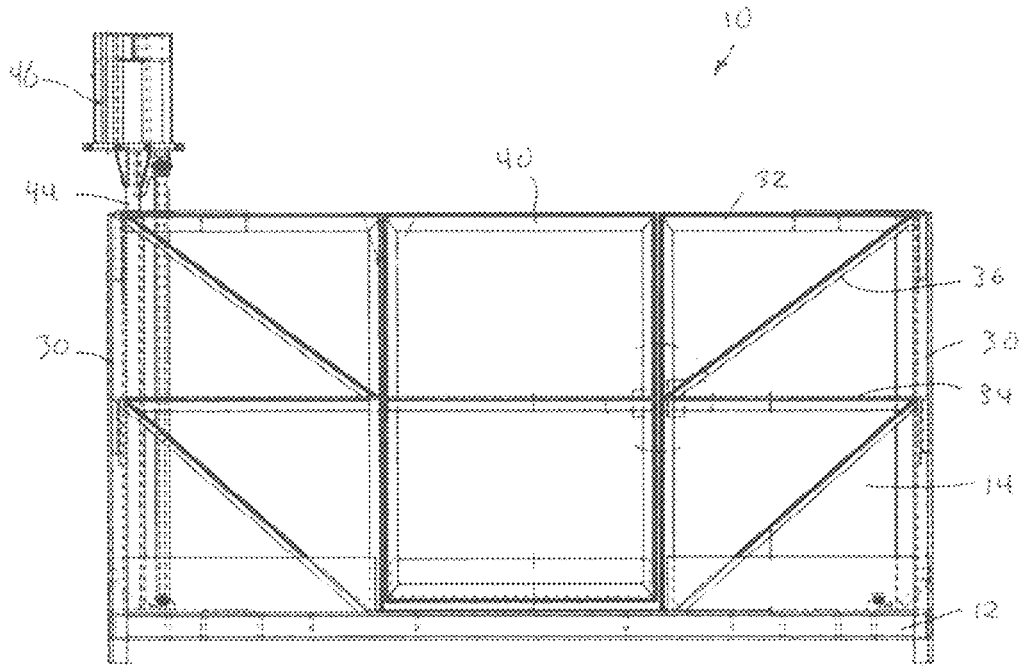
FIG. 4 is a front elevation view of the first embodiment.
Figure 5:
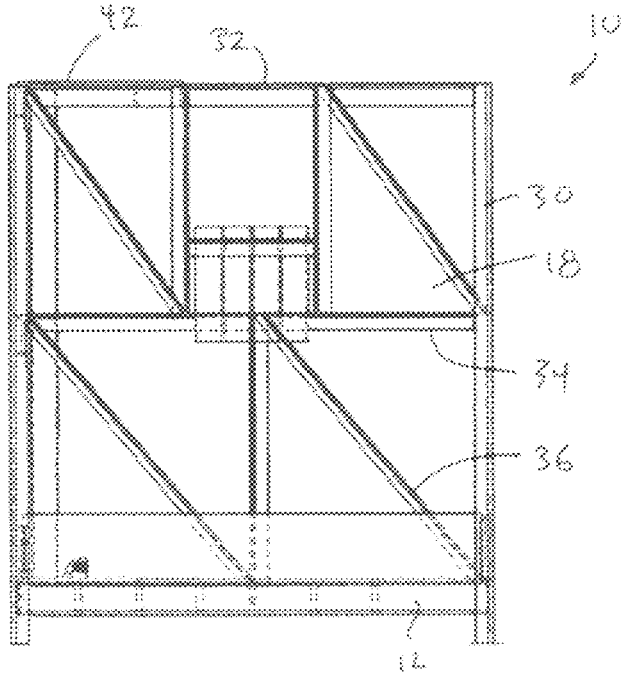
FIG. 5 is a right side elevation view of the first embodiment.
Figure 6:
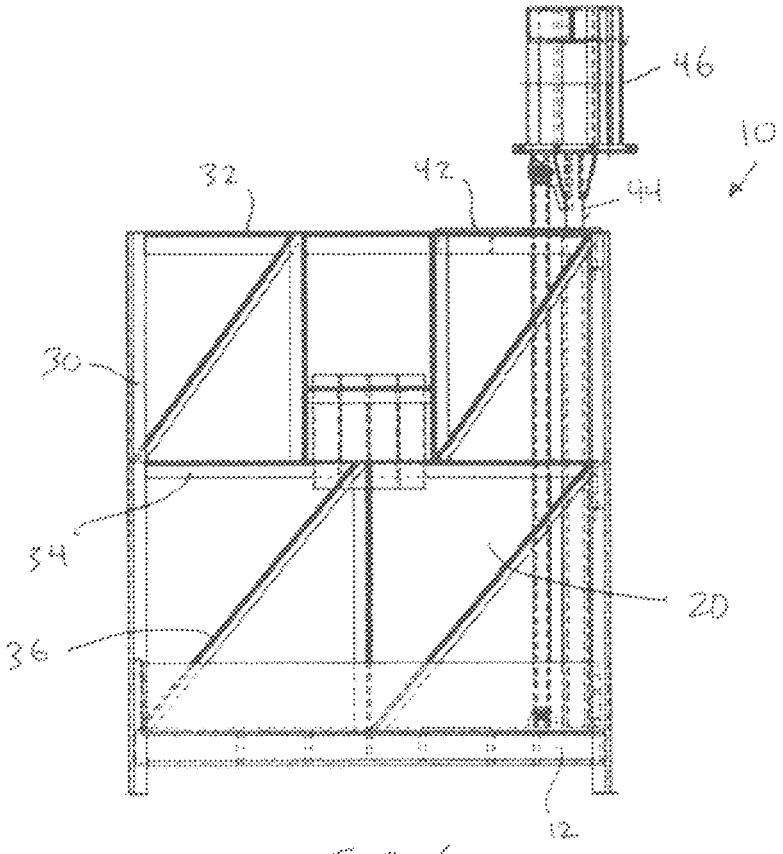
FIG. 6 is a left side elevation view of the first embodiment.

The post assembly 44 (which provides a guide or track to control the drill moving vertically as the cylinder is providing force to move the drill) supports a drill bracket 46, as can best be seen in FIGS. 1, 4 and 6. While one exemplary drill bracket 46 is illustrated, it will be clear to those skilled in the art that the specific bracket configuration will be selected for the drill in question. In the illustrated embodiment, the bracket design is selected for a drill directed in a generally vertical direction.

The corner plate 42 which supports the post assembly 44 and drill bracket 46 connects to the forward end of a tension member 50, which is described in detail below. The single tension member 50 can be relocated between corner plates 42 depending on which corner plate 42 is used to receive the post assembly 44 and drill bracket 46.

Figure 7A:
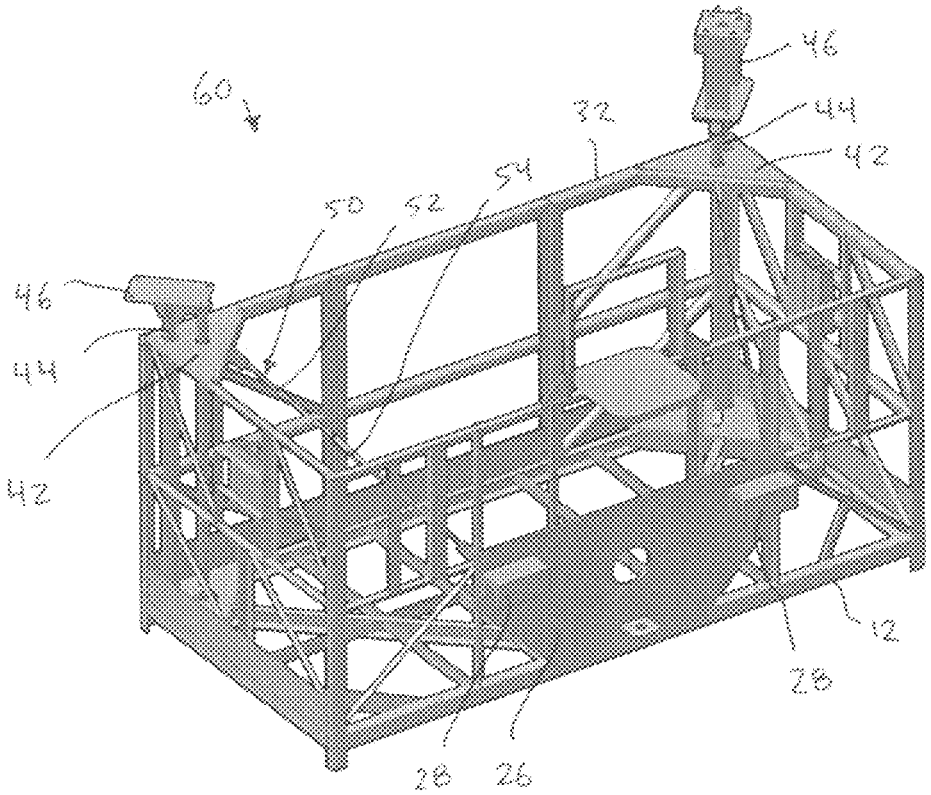
FIG. 7*a* is a rear perspective view of a second embodiment of the present invention, with two drill mount assemblies.
Figure 7B:
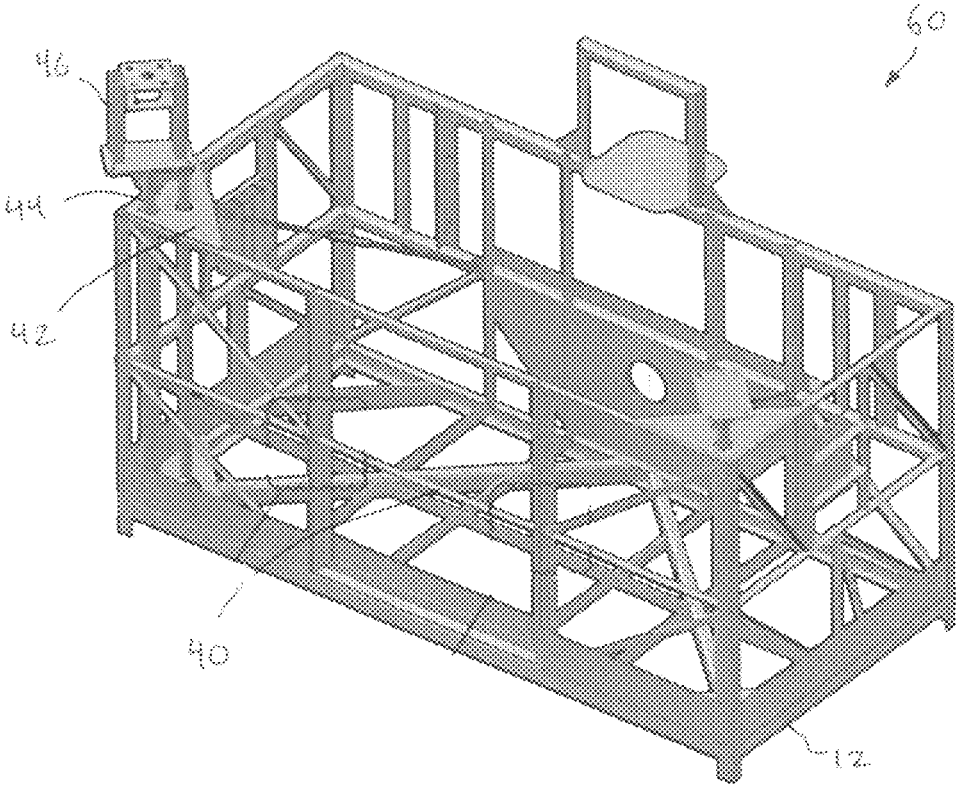
FIG. 7*b* is a front perspective view of a second embodiment.

FIGS. 7*a* and 7*b* illustrate a second embodiment of the present invention, showing a drill basket 60. While similar in many respects to the drill basket 10 of the first exemplary embodiment, the drill basket 60 differs in having a slightly different lifting assembly 26, but most significantly in having two post assemblies 44 and drill brackets 46 installed, each with a dedicated tension member 50. The drill basket 10 had corner plates 42 at each end of the forward wall 14, and the post assembly 44 and drill bracket 46 could be moved between them as desired, with the single tension member 50 capable of connection to whichever corner plate 42 was currently in use. With the alternative drill basket 60, it is shown that post assemblies 44 and drill brackets 46 can be installed in both corner plates 42 at the same time, with a tension member 50 connected to each of them concurrently. In this way, switching the drill (not shown) between drill brackets 46 where desirable is made simpler and more efficient, rather than requiring removal and relocation of the components.

Figure 8:
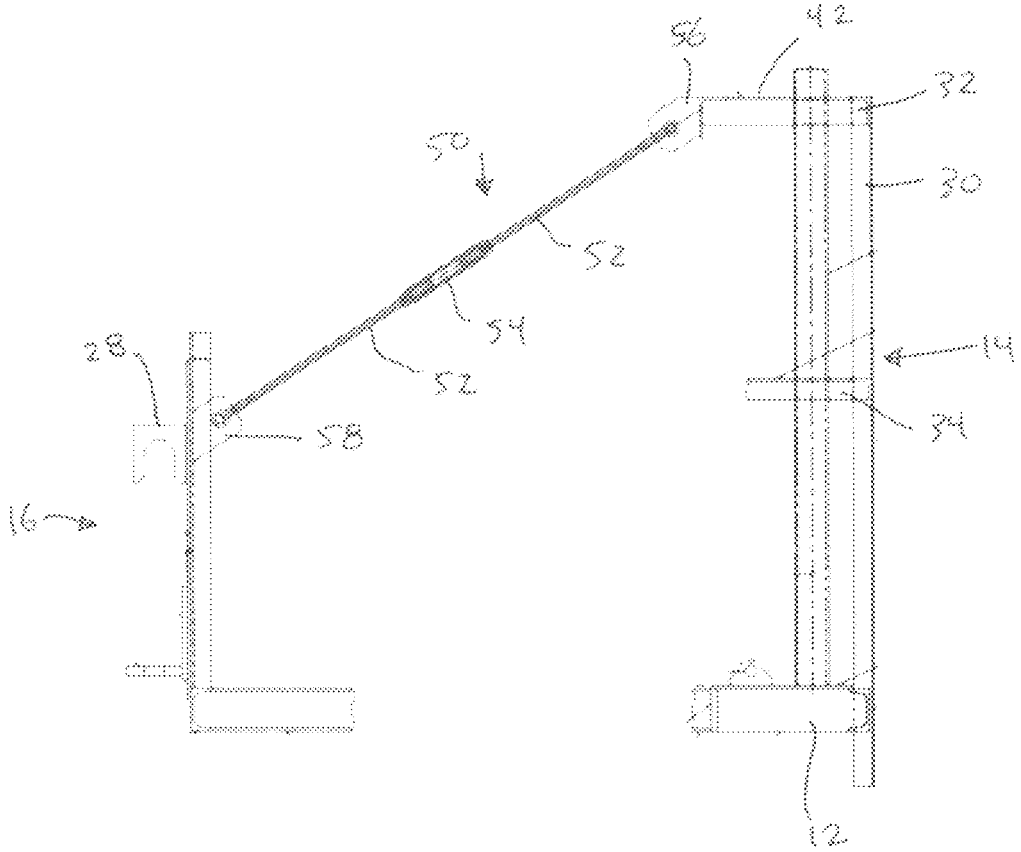
FIG. 8 is a side detail view of an exemplary tension member according to the present invention.

As has been indicated above, tension members 50 are installed to provide structural stability to the drill basket 10 or 60. FIG. 8 is a detailed elevation view of an exemplary tension member 50. In the illustrated embodiment, the tension member 50 comprises tension rods 52 connected by a turnbuckle 54. In a conventional manner well known to those skilled in the art, the turnbuckle can be used to increase tension in the tension rods, thus increasing stability of the drill basket 10 or 60 and inhibiting structural flexing. In the illustrated embodiment, the corner plate 42 is provided with a forward connection bracket 56, which bracket 56 is preferably welded to the corner plate 42. The forward end of the tension member 50 is connected to the bracket 56. At the rear of the drill basket 10 or 60, a corresponding rearward connection bracket 58 is welded to the rearward wall 14.

As will be clear from FIGS. 2 and 8, the rearward connection bracket 58 is located lower than the forward connection bracket 56—the rearward connection bracket 58 shown as generally in line with the height of the connection members or lifting lugs 28—and further toward the centre of the drill basket 10 or 60. Simulations have confirmed that by providing tension members 50 that angle downwardly and centrally, structural stability of the drill basket 10 or 60 is enhanced.

While tension rods and turnbuckles have been illustrated, it will be clear to those skilled in the art that other types of tensioning mechanisms are possible.

As will be clear, drill baskets in accordance with the present invention may have significant advantages over prior art solutions. The use of tension members allows an operator to position the drill assembly at the front of the unit while maintaining desirable stability in the face of significant twisting force and pushing force from the foot of the drill, and the use of high tensile steel in addition to the tensioning mechanism allows for a lighter basket design that can be safely lifted using conventional on-site equipment such as telehandlers. In addition, the use of tension members allows for a lighter basket design without sacrificing structural stability. Also, using equipment such as telehandlers provides a source of hydraulic power that can be used to power the drill itself, reducing the amount of auxiliary equipment required.

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof.
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.
- the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

The invention claimed is:

1. A work platform comprising:

a base;

a peripheral wall connected to the base, the peripheral wall comprising a forward wall and a rearward wall;

at least one drill assembly mounting member on a leading edge of the forward wall, the drill assembly mounting member configured to receive a drill assembly; and a tension member configured for stabilizing the work platform, the tension member connected to the forward wall adjacent the drill assembly mounting member and extending rearwardly and downwardly to connect to the rearward wall;

wherein the tension member is connected at a forward end to an upper corner of the forward wall, and at a rearward end to a lower middle portion of the rearward wall.

2. The work platform of claim 1 wherein the base is configured to support at least one person.

3. The work platform of claim 1 wherein the base and the peripheral wall are composed at least partly of high tensile steel.

4. The work platform of claim 3 wherein the high tensile steel is Hardox™ 700.

5. The work platform of claim 1 wherein the peripheral wall further comprises two side walls.

6. The work platform of claim 1 wherein the at least one drill assembly mounting member is located adjacent at least one end of the forward wall.

7. The work platform of claim 6 wherein the at least one drill assembly mounting member comprises two drill assembly mounting members, one at each end of the forward wall, a forward end of the tension member selectively connectable to the peripheral wall adjacent either of the drill assembly mounting members.

8. The work platform of claim 1 wherein the tension member comprises a tension rod and turnbuckle.

9. A drill basket for use with positioning equipment, the drill basket comprising:

a walled work platform comprising a forward wall and a rearward wall;

a mount on the rearward wall for mounting the drill basket on the positioning equipment;

at least one drill attachment point on the forward wall for receiving a drill; and a tension member configured for stabilizing the drill basket, the tension member connected to the forward wall adjacent the drill attachment point and extending rearwardly and downwardly to connect to the rearward wall ;

wherein the tension member is connected at a forward end to an upper front corner of the forward wall, and at a rearward end to a lower middle portion of the rearward wall.

10. The drill basket of claim 9 wherein the positioning equipment is a telehandler.

11. The drill basket of claim 10 wherein the telehandler is provided with a hydraulic power source, such that the drill can be powered using the hydraulic power source.

12. The drill basket of claim 9 wherein the forward wall comprises first and second ends.

13. The drill basket of claim 12 wherein the at least one drill attachment point is located at either the first end or the second end.

14. The drill basket of claim 12 wherein the at least one drill attachment point comprises two drill attachment points, one at each of the first end and the second end, a forward end of the tension member selectively connectable to the forward wall adjacent either of the drill attachment points.

15. The drill basket of claim 9 wherein the walled work platform is configured to support at least one person.

16. The drill basket of claim 9 wherein the walled work platform is composed at least partly of high tensile steel.

17. The drill basket of claim 9 wherein the tension member comprises a tension rod and turnbuckle.

18. A drilling system comprising:

positioning equipment;

a drill basket supported by the positioning equipment for positioning the drill basket adjacent a surface to be drilled, the drill basket comprising:

a walled work platform comprising forward wall and a rearward wall;

a mount on the rearward wall for mounting the drill basket on the positioning equipment;

at least one drill attachment point on the forward wall; and a tension member configured for stabilizing the drill basket, the tension member connected to the forward wall adjacent the drill attachment point and extending rearwardly and downwardly to connect to the rearward wall; wherein the tension member is connected at a forward end to an upper front corner of the forward wall, and at a rearward end to a lower middle portion of the rearward wall; and a drill assembly mounted on the drill attachment point, the drill assembly comprising a drill configured for drilling into the surface.

19. The drilling system of claim 18 wherein the positioning equipment is a telehandler.

20. The drilling system of claim 19 wherein the telehandler is provided with a hydraulic power source, further comprising hydraulic lines between the telehandler and the drill such that the drill can be powered using the hydraulic power source.

21. The drilling system of claim 18 wherein the forward wall comprises first and second ends.

22. The drilling system of claim 21 wherein the at least one drill attachment point is located at either the first end or the second end.

23. The drilling system of claim 21 wherein the at least one drill attachment point comprises two drill attachment points, one at each of the first end and the second end, a forward end of the tension member selectively connectable to the forward wall adjacent either of the drill attachment points.

24. The drilling system of claim 18 wherein the walled work platform is configured to support at least one person.

25. The drilling system of claim 18 wherein the walled work platform is composed at least partly of high tensile steel.

26. The drilling system of claim 18 wherein the tension member comprises a tension rod and turnbuckle.

* * * * *